US005485876A

United States Patent [19]

Horimura

[11] Patent Number: 5,485,876

[45] Date of Patent: Jan. 23, 1996

[54] PROCESS FOR PRODUCING METAL MATERIAL WITH EXCELLENT MECHANICAL PROPERTIES

[75] Inventor: Hiroyuki Horimura, Saitama, Japan

[73] Assignee: Honda Giken Kogyo Kabushiki Kaisha, Tokyo, Japan

[21] Appl. No.: 83,832

[22] Filed: Jun. 25, 1993

[30] Foreign Application Priority Data

Jun. 30, 1992 [JP] Japan ..... 4-172658

[51] Int. Cl.[6] ..... B22D 7/10

[52] U.S. Cl. ..... 164/122; 164/463; 164/154.1

[58] Field of Search ..... 164/463, 427, 164/122.1, 122, 120, 154

[56] References Cited

U.S. PATENT DOCUMENTS

| | | | |
|---|---|---|---|
| 3,719,733 | 3/1973 | Rakestra et al. . | |
| 4,011,901 | 3/1977 | Flemings et al. . | |
| 4,142,571 | 3/1979 | Narasimhan . | |
| 4,738,712 | 4/1988 | Singer | 75/0.5 B |
| 4,791,979 | 12/1988 | Liebermann | 164/463 |
| 4,844,146 | 7/1989 | Kikuchi | 164/319 |
| 5,014,764 | 5/1991 | Garat | 164/34 |
| 5,213,148 | 5/1993 | Masumoto et al. | 164/122 |
| 5,279,389 | 1/1994 | Horimura | 164/47 |

FOREIGN PATENT DOCUMENTS

| | | |
|---|---|---|
| 318875A1 | 6/1989 | European Pat. Off. . |
| 406770A1 | 1/1991 | European Pat. Off. . |
| 4711460 | 7/1972 | Japan . |
| 59-42586 | 10/1984 | Japan . |
| 3204160 | 9/1991 | Japan . |
| 3253525 | 11/1991 | Japan . |
| 2239874 | 7/1991 | United Kingdom . |
| 2243617 | 11/1991 | United Kingdom . |

OTHER PUBLICATIONS

"Fundamentals of Solidification", Kurz, Fisher, Trans Tech Pub (1986) p. 2.

"Metals Handbook", Desk edition, ASM (1985) p. 2–19.

*Primary Examiner*—Kurt Rowan
*Attorney, Agent, or Firm*—Lyon & Lyon

[57] ABSTRACT

In producing a metal material having a single-phase texture of an amorphous phase, a supercooled liquid having an amorphous composition is first prepared in a melting manner within a large-diameter pipe portion of a quartz pipe. Then, the supercooled liquid is converted into another form by allowing it to flow into a small-diameter pipe portion. The form conversion causes the temperature of the supercooled liquid to rise, so that the temperature of the supercooled liquid is uniformalized by this temperature-increase effect, thereby inhibiting the production of non-uniform crystal nuclei. Thereafter, the quartz pipe with the supercooled liquid contained therein is placed into a water bath, where the supercooled liquid is cooled by water and solidified.

20 Claims, 7 Drawing Sheets

PROCESS FOR PRODUCING METAL MATERIAL WITH EXCELLENT MECHANICAL PROPERTIES

BACKGROUND OF THE INVENTION

1. Field of the Invention

The field of the present invention is processes for producing metal materials with excellent mechanical properties.

2. Description of the Prior Art

Such conventionally known metal materials include those having metastable phases of an amorphous alloy, a supersaturated solid solution and the like, and those having a single-phase texture of a fine and uniform crystalline phase. In producing these metal materials, a liquid quenching process such as a high pressure gas atomization process, melt-spinning process (single-roll process) and the like is generally employed (for example, see Japanese Patent Application Laid-open No. 11460/72, Japanese Patent Publication Kokoku No. 42586/84).

However, the liquid quenching process is accompanied by a problem of a defective industrial product since a higher cooling rate is required, which dominates the mechanical properties of the metal material.

SUMMARY OF THE INVENTION

It is an object of the present invention to provide a producing process of the type described above which provides a good industrial product, wherein a metal material having a metastable phase and the like can be produced even if the cooling rate is reduced.

To achieve the above object, according to the present invention, there is provided a process for producing a metal material with excellent mechanical properties, comprising the steps of allowing a supercooled liquid of a metal to flow and converting it from a basic form into another form, thereby increasing the temperature thereof, and subjecting the supercooled liquid to a cooling treatment to solidify it.

The supercooled liquid has a high viscosity and hence, if it is allowed to flow and converted from the basic form to another form, the temperature thereof increases due to an internal resistance (friction). This temperature-increase effect enables the temperature of the supercooled liquid to become uniform, thereby inhibiting the production of non-uniform crystal nuclei. A metal material having a metastable phase texture such as a single-phase texture of an amorphous phase, a mixed-phase texture or the like or having a single-phase texture of a fine and uniform crystalline phase can be produced from such a supercooled liquid, even by use of a cooling treatment such as a water-cooling with a cooling rate lower than that in the prior art process. In addition, a relatively simple means is employed, leading to a good industrial product and productivity.

The above and other objects, features and advantages of the invention will become apparent from a consideration of the following description of the preferred embodiments, taken in conjunction with the accompanying drawings.

DESCRIPTION OF THE PREFERRED EMBODIMENTS

The present inventors have examined a temperature-increase effect for various supercooled liquids metals, when they have been flowed and converted from a basic form into another form, and as a result, it has been found that such temperature-increase effect has been influenced by the viscosity at the start of the form conversion and the form conversion rate and proportion of the supercooled liquid.

Factors of the influence exerted on the temperature-increase effect will be described below.

I. Viscosity A at the start of form conversion of supercooled liquid

A magnesium alloy having an amorphous composition represented by $Mg_{65}Cu_{25}Y_{10}$ (each of numerical values represents atomic percent, and melting point $T_1$=711 K) was placed in a viscosity measuring metal mold 2. The metal mold 2 includes a heater 1 and has a property capable of maintaining the entire mold 2 at a uniform temperature. Then, the magnesium alloy was melted to provide a molten metal 3 having a temperature equal to or more than its melting point. Thereafter, the temperature of the molten metal 3 was measured by a thermocouple TC, while being gradually cooled through a natural cooling. In this case, the basic form of the molten metal is a form defined by the profile of the metal mold 2.

When the temperature of the molten metal 3 was dropped to a test temperature $T_2$, a punch 4, whose temperature was adjusted to the same point as the test temperature, was inserted into the molten metal 3 causing the molten metal to flow around the punch 4 and thus change forms. The new form of the molten metal is defined by the metal mold 2 and the punch 4. During the form conversion, the temperature of the molten metal 3 was measured likewise by the thermocouple TC. In this case, the form conversion rate B of the molten metal 3 was set at 1/sec or 3/sec (B=1/sec or B=3/sec) by unifying the insertion rate of the punch 4 and by varying the diameter of the punch 4. The form conversion rate B=3/sec means that the molten metal is flowed so that the height of the level thereof increases by 300% per second. More specifically, in this embodiment, the inside diameter a of the metal mold 2 was set at 26 mm, and the height b of the level of the molten metal at the time when the molten metal was in the basic form was set at 20 mm. On the other hand, the diameter c of the punch 4 was set at 22.6 mm, and the insertion rate of the punch 4 was set at 20 mm/sec. When the punch 4 was inserted into the molten metal until the lower end face thereof reached an inner bottom surface of the metal mold 2, the height of the level of the molten metal was about 80 mm and thus, the percentage of the level of the molten metal rising for one second was 300%. It is possible to set the form conversion rate B at 1/sec by setting the same conditions as those described above, except for the use of the punch 4 having a diameter of 18.4 mm.

Figure 1:
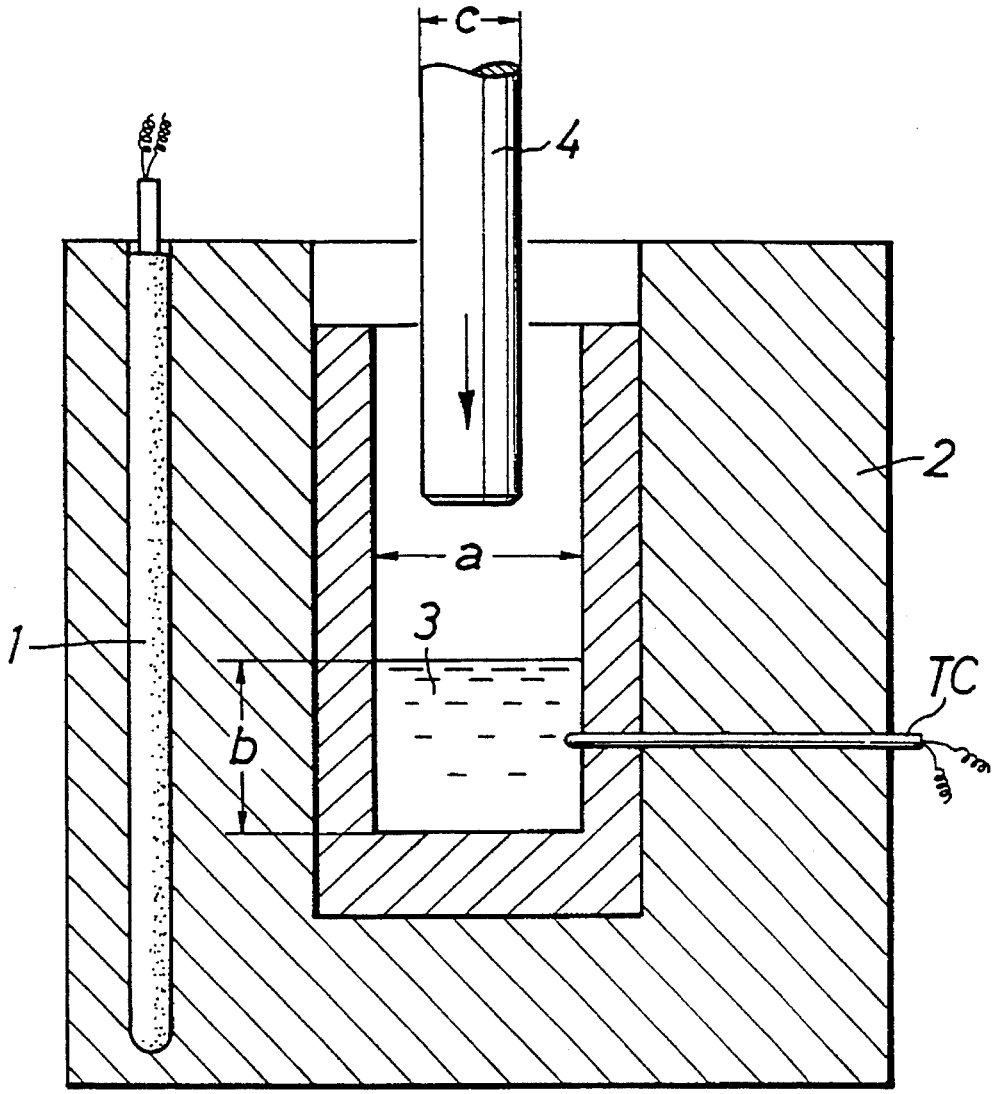
FIG. 1 is a schematic longitudinal cross-sectional view of a viscosity measuring metal mold.
Figure 2:
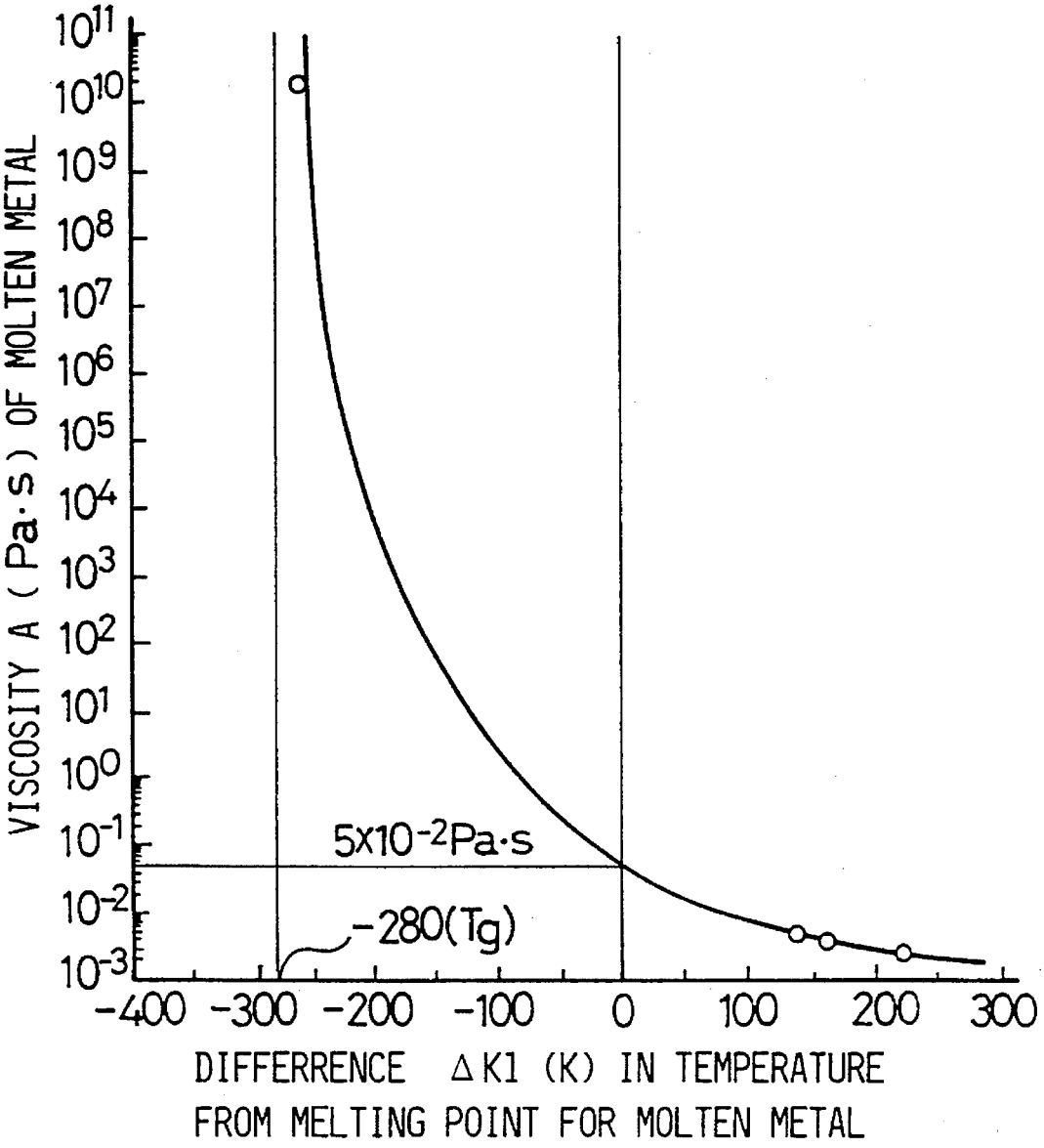
FIG. 2 is a graph illustrating the relationship between the difference in temperature from the melting point for a molten metal and the viscosity A of the molten metal.

FIG. 2 illustrates the relationship between the difference ΔK1 in temperature from the melting point ($T_1$=711 K) for a molten metal (magnesium alloy) having the same composition as described above and the viscosity A of the molten metal. The data was obtained by heating an amorphous magnesium alloy to various temperatures equal to or more than its glass transition temperature Tg (431 K), and the measuring the viscosity of the molten metal at each temperature. The molten metal takes on a supercooled liquid state in a range of temperature difference from the melting point represented by $-280\ K \leqq \Delta K1 \leqq 0\ K$, that is at a temperature between the glass transition temperature Tg and the melting point of the alloy.

Figure 3:
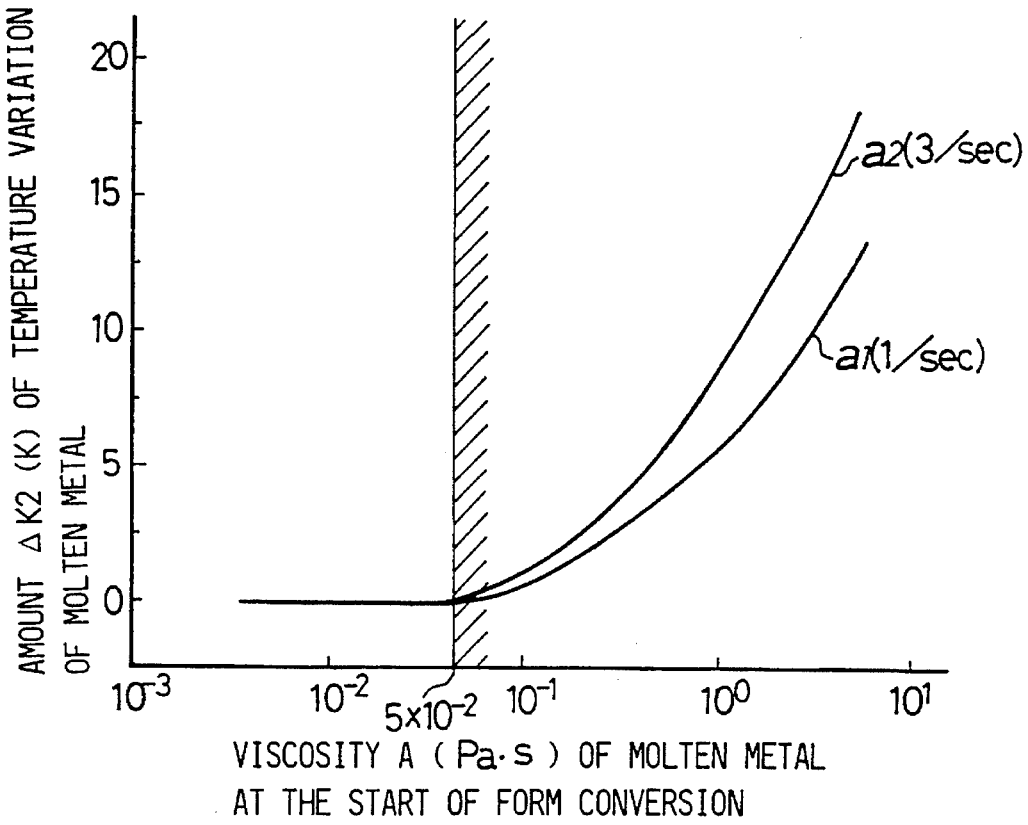
FIG. 3 is a graph illustrating the relationship between the viscosity A of the molten metal at the start of the form conversion and the amount ΔK2 of temperature variation of the molten metal.

The temperature difference $T_1$-$T_2$=ΔK1 was calculated on the basis of the test temperature $T_2$ at which the form of the molten metal was changed and then, the viscosity A of the molten metal at such temperature difference ΔK1 was determined by using FIG. 2. The result shown in FIG. 3 represents the relationship between the viscosity A and the amount of temperature variation, which is given by the temperature difference $T_3$-$T_2$=ΔK2 between the test temperature $T_2$ and a temperature $T_3$ of the molten metal during the form conversion. In FIG. 3, the line $a_1$ corresponds to the relationship when the form conversion rate B is equal to 1/sec, and the line $a_2$ corresponds to the relationship when the form conversion rate B is equal to 3/sec.

As is apparent from FIG. 3, a distinct increase in temperature was observed when the viscosity A of the molten metal at the start of the form conversion was equal to or more than $5\times10^{-2}$ Pa.s. It can be seen from this fact that if the form of the supercooled liquid is changed, a temperature-increase can be obtained by the temperature difference (the amount of temperature) ΔK2 as compared with the temperature prior to the form conversion.

II. Form conversion rate B of supercooled liquid

A molten metal of a magnesium alloy having the same composition ($Mg_{65}Cu_{25}Y_{10}$) as the magnesium alloy used in the above-described item I was prepared by a high frequency melting process, then, the molten metal was subjected to a single-roll process in order to produce a ribbon-like magnesium alloy having a width of 3 mm and a thickness of 0.05 mm. Conditions for the single-roll process were as follows: The diameter of a cooling roll of copper was 250 mm; the cooling roll revolution rate was 2,500 rpm; the diameter of an injection bore in a quartz nozzle was 0.5 mm; the gap between the quartz nozzle and the cooling roll was 0.5 mm; the pressure of injection of the molten metal was 0.6 kgf/cm$^2$; and under an argon atmosphere of −40 cmHg. The ribbon-like magnesium alloy was subjected to X-ray diffraction and differential thermal analysis (DSC), thereby examining the metallographic structure thereof. The result of these tests showed that the metallographic structure was of a single-phase texture of an amorphous phase.

The ribbon-like magnesium alloy was then heated to a level equal to or more than the glass transition temperature Tg (431 K) to provide a supercooled liquid. Next, the ribbon-like supercooled liquid was subjected to tension load to convert it into another form by causing the ribbon of supercooled liquid to flow at a form conversion rate B so as to form a gage length of 10 mm to 50 mm. The temperature of the supercooled liquid during the form conversion was measured to provide results shown in FIG. 4, wherein the line $b_1$ corresponds to the result obtained by starting the tensioning at a supercooled liquid temperature of 461 K and a viscosity A of $1\times10^8$ Pa.s, and the line $b_2$ corresponds to the result obtained by starting the tensioning at a supercooled liquid temperature of 471 K and a viscosity A of $2\times10^7$ Pa.s.

Figure 4:
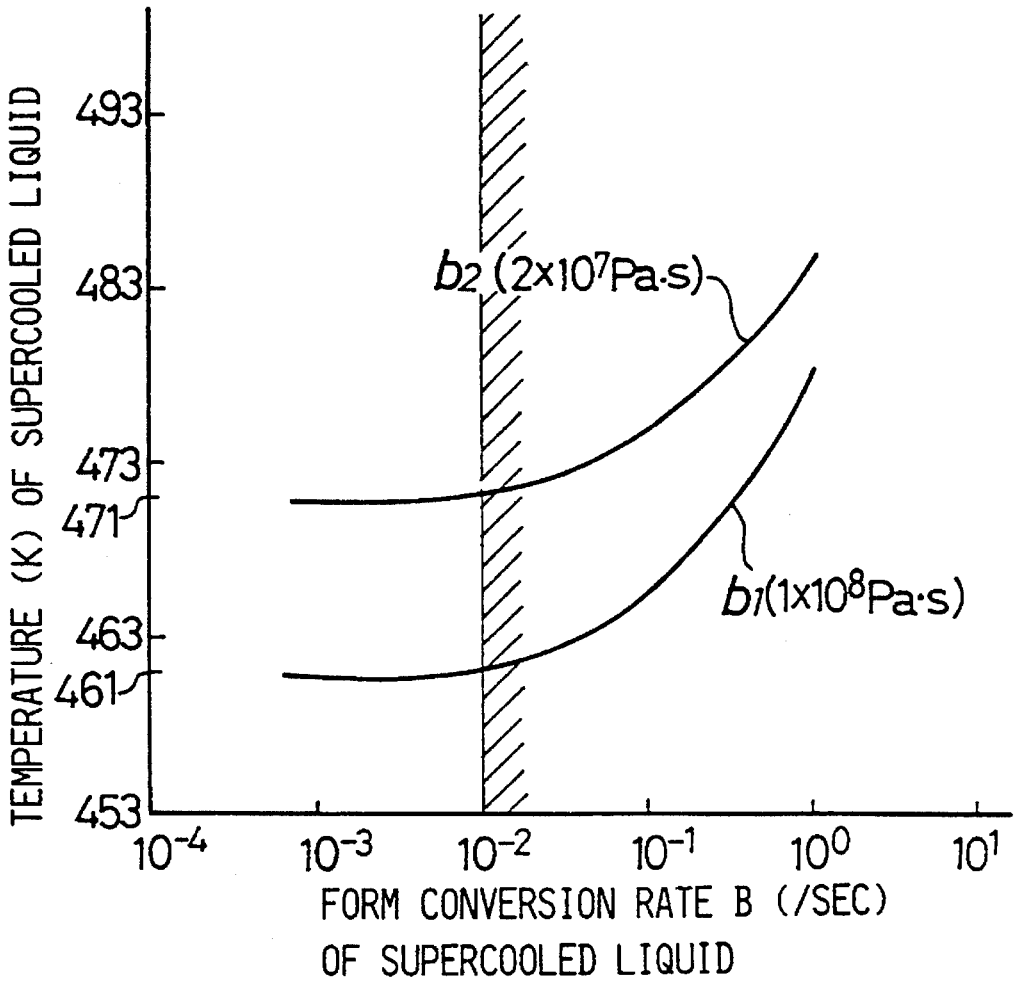
FIG. 4 is a graph illustrating the relationship between the form conversion rate B and the temperature of a supercooled liquid.

As is apparent from FIG. 4, it is possible to increase the temperature of the supercooled liquid by setting the form conversion rate B at a value equal to or more than 0.01/sec (which means that the length is increased by 1% per second).

III. Form conversion percent C of supercooled liquid

Figure 5:
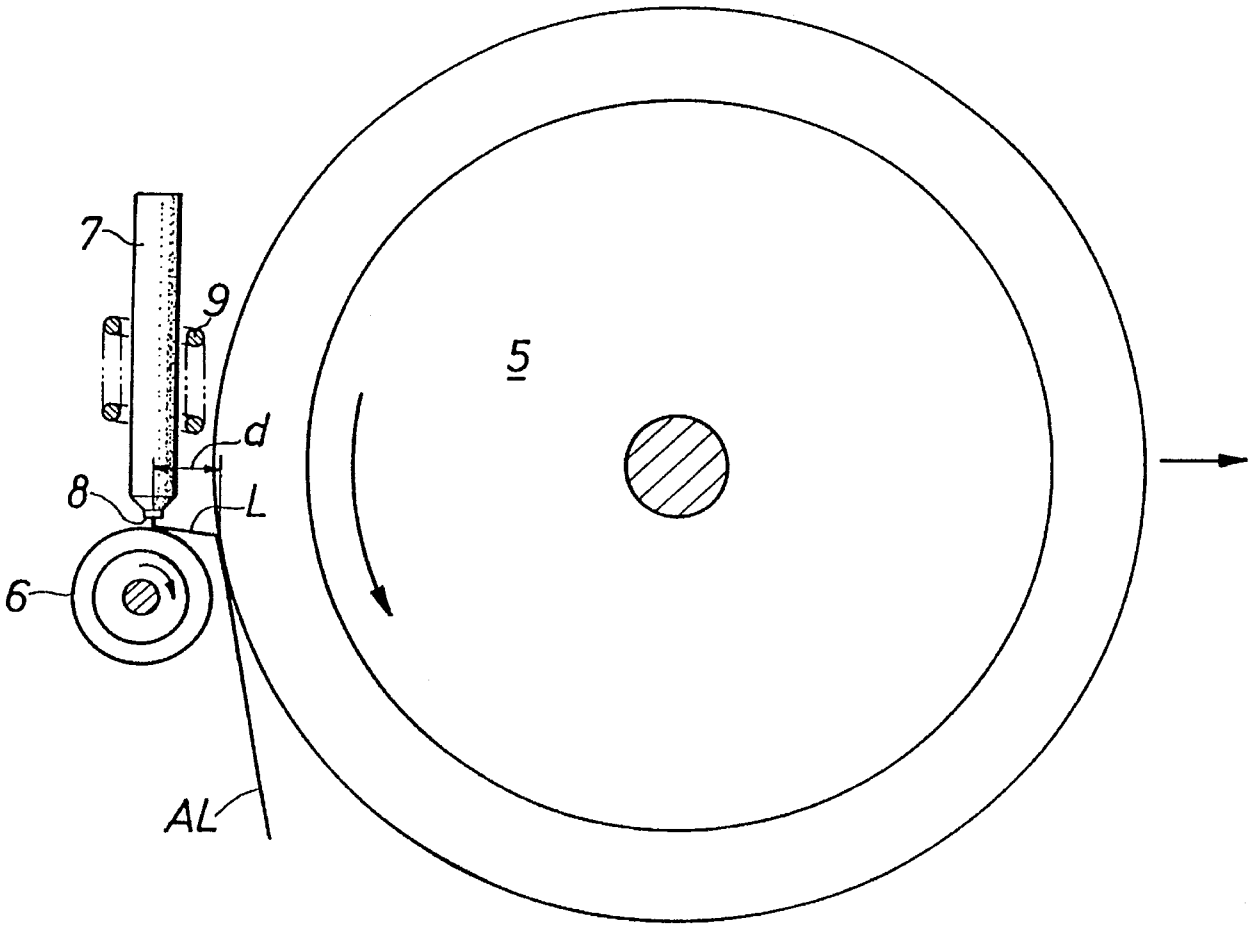
FIG. 5 is a schematic longitudinal cross-sectional view of a form conversion proportion measuring device.

FIG. 5 illustrates a schematic view of a form conversion proportion measuring device. Referring to FIG. 5, a form converting roll 6 of $Si_3N_4$ having a diameter of 30 mm is disposed on the side of a cooling roll 5 of copper having a diameter of 200 mm. A quartz nozzle 7 is disposed above the form converting roll 6 with its injection port 8 opposed to an outer peripheral surface of the form converting roll 6. The quartz nozzle 7 is surrounded by a high frequency coil of a heater 9. The cooling roll 5 is adapted to be moved horizontally to change the distance d between the outer peripheral surface thereof and the injection port 8 of the quartz nozzle 7. The form converting roll 6 is maintained at a predetermined temperature by the heater.

In measuring the form conversion proportion C, a molten metal of an aluminum alloy having an amorphous composition represented by $Al_{85}Ni_5Y_8Co_2$ (in which each of numerical values represents atomic percent, and a melting point is of 1170 K) was prepared within the quartz nozzle 7. The cooling roll 5 was rotated in a counterclockwise direction as viewed in FIG. 5 at a revolution rate of 2500 rpm, while the form converting roll 6 was rotated in a clockwise direction as viewed in FIG. 5, with the temperature thereof being maintained at 1073 K.

The molten metal was injected columnarly from the injection port 8 of the quartz nozzle 8 onto the outer peripheral surface of the form converting roll 6, thereby providing a supercooled liquid having a viscosity A of about 10 Pa.s at a temperature of about 1070 K (about 100 K below the melting point). Then, the supercooled liquid L was caused to flow in a direction of a generating line of the form converting roll 6 and converted into a ribbon-like form. Thereafter, the supercooled liquid L was moved toward the outer peripheral surface of the cooling roll 5 and cooled by the cooling roll 5 to provide a ribbon-like aluminum alloy AL. In this case, the form conversion proportion C of the supercooled liquid L was varied by varying the number of revolutions of the form converting roll 6, and the cooling roll 5 was moved to vary the distance d between the cooling roll 5 and the injection port 8.

The form conversion proportion C of the supercooled liquid was obtained in the following manner. The injection port 8 of the quartz nozzle 7 was shaped into a rectangle with its longer side parallel to the axis of the form converting roll 6, and the area of the rectangular section of the columnar supercooled liquid just before reaching the outer peripheral surface of the form converting roll 6 was obtained. The amount of supercooled liquid L injected and the number of revolutions of the form converting roll 6 were determined so that such sectional area and the area of the rectangular section of the ribbon-like supercooled liquid L separated from the outer peripheral surface of the form converting roll 6 were equal to each other. If shorter and longer sides of the rectangular section of the columnar supercooled liquid L are represented by $e_1$ and $f_1$, respectively, and shorter and longer sides of the rectangular section of the ribbon-like supercooled liquid L are represented by $e_2$ and $f_2$, respectively, the sectional areas of both the supercooled liquids L are equal to each other and hence, an expression, $e_1 \times f_1 = e_2 \times f_2$ is established. Thus, the form conversion percent C can be determined from both the longer sides $f_1$ and $f_2$ according to $C=\{(f_2-f_1)/f_1\{\times 100$ (%).

Figure 6:
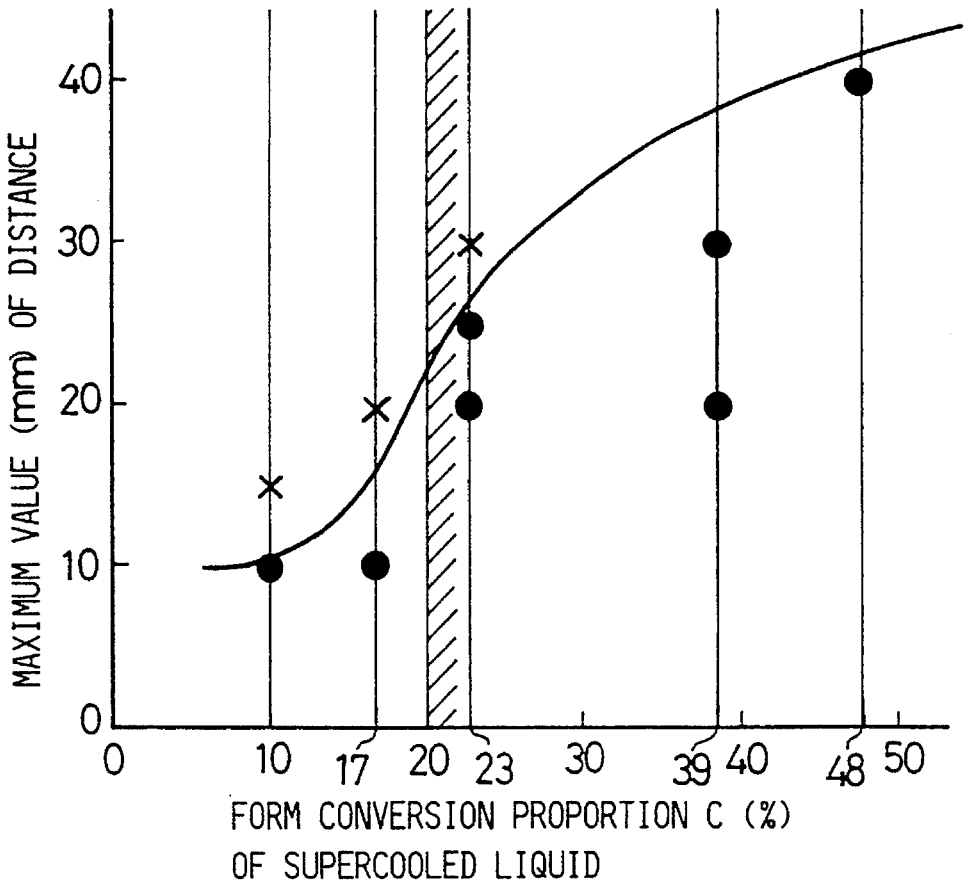
FIG. 6 is a graph illustrating the relationship between the form conversion proportion C of the supercooled liquid and the maximum value of the distance d.

The ribbon-like aluminum alloy produced in this manner was subjected to an X-ray diffraction to examine whether or not the crystallization thereof occurred, so as to obtain the relationship between the form conversion proportion of the supercooled liquid on the form converting roll 6 and the maximum distance d for enabling a ribbon-like aluminum alloy having a single-phase texture of an amorphous phase to be produced, thereby providing results shown in FIG. 6. In this figure, a "black dot (●)" mark indicates that the ribbon-like aluminum alloy has a single-phase texture of an amorphous phase, and a "X" mark indicates that the ribbon-like aluminum alloy has a mixed-phase texture consisting of a crystalline phase and an amorphous phase.

As is apparent from FIG. 6, if the form conversion proportion C of the supercooled liquid is set at a value equal to or more than 20% ($C \geqq 20\%$), e.g., at 23% ($C=23\%$), it is possible to produce a ribbon-like aluminum alloy having a single-phase texture of an amorphous phase, even if the maximum value of the distance d is set at 25 mm. However, if the form conversion proportion C is set at 17%, the metallographic structure of a ribbon-like aluminum alloy produced is of a mixed-phase texture, even if the maximum value of the distance d is reduced down to 20 mm. This means that if the form conversion proportion C of the supercooled liquid is set at a value equal to or more than 20% ($C \geqq 20\%$), it is possible to maintain the supercooled liquid in a liquid state over a time longer than when $C<20\%$. The experiment showed that the maximum value of the distance d could be increased up to 40 mm by setting the form conversion proportion C of the supercooled liquid at about 48%.

An example of production of a metal material will be described specifically.

Figure 7:
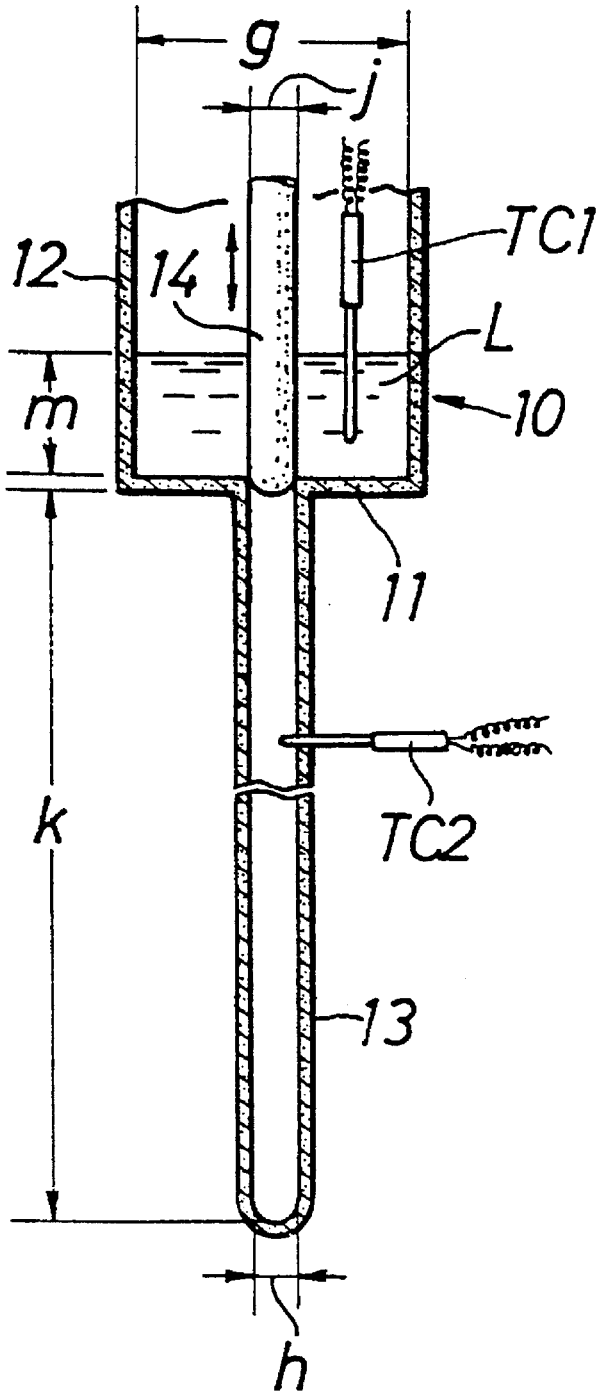
FIG. 7 is a schematic longitudinal cross-sectional view of a metal material producing apparatus.

FIG. 7 illustrates a schematic view of a producing apparatus. A quartz pipe 10 includes a melting large-diameter pipe portion 12 with a bottom wall 11 formed flat, and a form-converting small-diameter pipe portion 13 communicating with the melting large-diameter pipe portion 12 through the bottom wall 11. The form-converting small diameter pipe is closed at its lower end. A stopper 14 is disposed within the large-diameter pipe portion 12 for opening and closing an opening of the small-diameter pipe portion 13. The large-diameter pipe portion 12 has an inside diameter g of 14 mm; the small-diameter pipe portion 13 has an inside diameter h of 4 mm; the stopper 14 has an outside diameter j of about 4.26 mm; and the small-diameter pipe portion 13 has a length k of 100 mm.

In a condition in which the opening of the small-diameter pipe portion 13 had been closed, a magnesium alloy having the same composition ($Mg_{65}Cu_{25}Y_{10}$) as the magnesium alloy used in the above-described item I was placed in the large-diameter pipe portion 12, and the quartz pipe 10 was placed in an infrared heating furnace. Then, the infrared heating furnace was operated to melt the magnesium alloy. After melting the alloy, the operation of the infrared heating furnace was stopped, and the temperature of the molten metal was measured by a thermocouple TC1 disposed within the large-diameter pipe portion 12. In this case, the height m of the molten metal level was set at 9 mm (m=9 mm). After the temperature of the molten metal was dropped down to a level equal to or lower than the melting point (711 K), so that the molten metal becomes a supercooled liquid L1 the stopper 14 was operated to open the opening' of the small-diameter pipe portion 13, thereby allowing the supercooled liquid L to flow into the small-diameter pipe portion 13 under an action of an argon gas pressure to change the form of the supercooled liquid L into another form. The temperature of the supercooled liquid L during the form conversion was measured by a thermocouple TC2 mounted in the small-diameter pipe portion 13. When the temperature of the supercooled liquid L within the small-diameter pipe portion 13 reached a predetermined value, the quartz pipe 10 was placed in a water bath to solidify the supercooled liquid L, thereby providing a rounded bar-like metal material made of the magnesium alloy and having a diameter of 4 mm.

At the start of the flowing-down of the supercooled liquid into the small-diameter pipe portion 13, i.e., at the start of the form conversion, the viscosity A of the supercooled liquid L was about $8\times10^{-2}$ to $2\times10^{-1}$ Pa.s; the form conversion rate B was about 18/sec to about 56/sec; the form conversion proportion C was about 1000%; and the time taken from the stoppage of the operation of the infrared heating furnace to the submerging of the quartz pipe 10 into the water bath was at most 5 seconds. In this case, the form conversion rate B was set at various values by adjusting the argon gas pressure so as to vary the time taken from the start of flowing of the supercooled liquid L into the small-diameter pipe portion 13 to the completion of such flowing. For example, if the time is set at 0.55 seconds, the height m (=9 mm) of the molten metal level is changed to the height k (=100 mm) of the small-diameter pipe portion 13 within such time and hence, the percentage of the raised level of the molten metal in 0.55 seconds is about 1000%. Based thereon, if the percentage of the raised level in one second is calculated and it results in about 1800% and therefore, the form conversion rate B is about 18/sec ($B \doteq 18$/sec), because the form conversion rate B is equal to 0.01/sec when the length is increased by 1% in one second, as described above. A form conversion rate B approximately equal to 56/sec ($B \doteq 56$/sec) applies when the time is set at 1000/5600 seconds, i.e., at 0.18 seconds. The form conversion proportion C is represented by $C=\{(S_1-S_2)/S_2\}\times 100$ (%), wherein $S_1$ represents an area of the section (annular section) of the supercooled liquid L in the large-diameter pipe portion 12, and $S_2$ represents an area of the section (circular section) of the supercooled liquid L in the small-diameter pipe portion 13.

Table 1 shows the relationship in various metal materials between the metallographic structures and various temperature conditions for producing the metal materials. The metal materials (1) to (9) were produced by the above-described process, and the metal materials (10) to (13) are comparative examples and were produced without conversion of the form in a supercooled liquid state as described above. In Table 1, "amo" means a single-phase texture of an amorphous phase; "cry" means a single-phase texture of a crystalline phase; and "amo"+"cry" means a mixed-phase texture consisting of an amorphous phase and a crystalline phase.

TABLE 1

| | Temperature condition | | | | | |
|---|---|---|---|---|---|---|
| M.M. | TC1 (K) | ΔK1 (K) | TC2(con) (K) | ΔK2 (K) | TC2(cool) (K) | Me.St. |
| (1) | 704 | −7 | 706 | +2 | 703 | amo |
| (2) | 699 | −12 | 702 | +3 | 696 | amo |
| (3) | 696 | −15 | 702 | +6 | 693 | amo |
| (4) | 692 | −19 | 696 | +4 | 691 | amo |
| (5) | 683 | −28 | 693 | +10 | 690 | amo |
| (6) | 692 | −19 | 696 | +4 | 685 | amo |
| (7) | 692 | −19 | 697 | +5 | 679 | amo + cry |
| (8) | 692 | −19 | 697 | +5 | 676 | amo + cry |
| (9) | 692 | −19 | 697 | +5 | 665 | cry |
| (10) | 723 | +12 | 722 | −1 | 720 | cry |
| (11) | 723 | +12 | 722 | −1 | 703 | cry |
| (12) | 715 | +4 | 713 | −2 | 703 | cry |
| (13) | 715 | +4 | 714 | −1 | 696 | cry |

M.M. = Metal material
TC1 = Temperature at the start of conversion of form
ΔK1 = Difference between TC1 and the melting point (711 K.)
TC2(con) = Temperature during conversion of form
ΔK2 = Difference between TC2(con) and TC1
TC2(cool) = Temperature at the start of water-cooling
Me.St. = Metallographic structure With the metal materials (1) to (6) in Table 1, the metallographic structure is the single-phase texture of an amorphous phase ("amo"), because an increase in temperature ΔK2 is generated when the form of the supercooled liquid, is changed and the water-cooling was conducted at a higher temperature of the supercooled liquid so as to maintain the temperature-increase effect sufficiently. With the metal materials (7) and (8), the metallographic structure is the mixed-phase texture ("amo+ cry") because the temperature of the supercooled liquid at the start of water-cooling was set at a level lower than the above-described level, thereby causing a decreasing tendency of the temperature-rise effect immediately before the water-cooling, resulting in a generation of a partial crystallization. But the texture thereof is fine, because the growth of crystal grains cannot occur quickly. With the metal material (9), the metallographic structure is the single-phase texture of a crystalline phase ("cry"), because the temperature of the supercooled liquid at the start of water-cooling was set at a further lower level, as compared with that of material (7) and the like. In this case, the texture thereof is fine and uniform, because the temperature of the supercooled liquid at the water-cooling is 665 K, and the growth of crystal grains at this temperature is extremely slow.

With the metal material (10) as the comparative example, the metallographic structure is a single-phase texture of a relatively fine crystalline phase, but the fineness and the uniformity of the texture are inferior to those of the metal material (9), because the temperature of the molten metal at the start of the water-cooling step is equal to or more than the melting point. With the metal materials (11) to (13) as the comparative examples, the metallographic structure is a single-phase texture of a coarse and non-uniform crystalline phase, due to a non-uniform crystallization occurring before the water-cooling, because the temperature of the molten metal at the water-cooling is equal to or less than the melting point, and the form conversion in the supercooled liquid state is not conducted as described above.

If a cooling rate equivalent to that in the conventional liquid-quenching process is employed, it is possible to produce an amorphous metal material with more of an increase in size than that being achieved in the prior art.

What is claimed is:

1. A process for producing a metal material with excellent mechanical properties, comprising the steps of:

producing a metal having a melting temperature (Tm) and a glass transition temperature (Tg);

placing the metal in a supercooled liquid state by setting the temperature (T) of the metal in a range of $Tg \leqq T \leqq Tm$;

causing the supercooled liquid metal, which is included in a container and has a basic form defined by the shape of the container, to flow into a second container so that the form of the supercooled liquid is changed to a second form defined by the second container, thereby increasing the temperature of the supercooled liquid;

allowing the temperature of the supercooled liquid metal of a changed form to become uniform, thereby inhibiting the production of non-uniform crystal nuclei; and thereafter subjecting said supercooled liquid of a changed form to a cooling treatment to solidify said supercooled liquid.

2. A process for producing a metal material with excellent mechanical properties, comprising the steps of:

producing a metal having a melting temperature (Tm) and a glass transition temperature (Tg);

placing the metal in a supercooled liquid state by setting the temperature (T) of the metal in a range of $Tg \leqq T \leqq Tm$;

causing the supercooled liquid metal, which is included in a container and has a basic form defined by the shape of the container, to flow into a second container so that the form of the supercooled liquid is changed to a second form defined by the second container, thereby increasing the temperature of the supercooled liquid, and wherein the viscosity A of the supercooled liquid at the start of the form conversion is set at a value equal to or more than $5\times10^{-2}$ Pa.s ($A \geqq 5\times10^{-2}$ Pa.s), the form conversion rate B is set at a value equal to or more than 0.01/sec ($B \geqq 0.01$/sec), and the form conversion proportion C is set at a value equal to or more than 20% ($C \geqq 20\%$);

allowing the temperature of the supercooled liquid metal of a changed form to become uniform, thereby inhibiting the production of non-uniform crystal nuclei; and thereafter subjecting said supercooled liquid of a changed form to a cooling treatment to solidify said supercooled liquid.

3. A process for producing a metal material with improved mechanical properties, comprising the steps of:

producing a metal having a melting temperature (Tm) and a glass transition temperature (Tg);

placing the metal in a supercooled liquid state by setting the temperature (T) of the metal in a range of $Tg \leqq T \leqq Tm$;

causing the supercooled liquid metal, which is included in a container and has a basic form defined by the shape of the container, to flow into a second container so that the form of the supercooled liquid is changed to a second form defined by the second container, thereby causing an increase in temperature of the metal;

allowing the temperature of the supercooled liquid metal of a changed form to become uniform, thereby inhibiting the production of non-uniform crystal nuclei; and thereafter subjecting the supercooled liquid metal of a changed form to an immediate cooling treatment to solidify said supercooled liquid metal and maintain the metallographic structure of the supercooled liquid metal.

4. The process of claim 3, wherein the viscosity of the supercooled liquid metal at the start of the form change is equal to or more than $5\times10^{-2}$ Pa.s.

5. The process of claim 3, wherein the form conversion rate during the form change is equal to or more than 0.01/sec.

6. The process of claim 3, wherein the form conversion proportion during the form change is equal to or more than 20%.

7. The process of claim 6, wherein the viscosity of the supercooled liquid metal at the start of the form change is equal to or more than $5\times10^{-2}$ Pa.s.

8. The process of claim 6, wherein the form conversion rate during the form change is equal to or more than 0.01/sec.

9. The process of claim 4, wherein the form conversion rate during the form change is equal to or more than 0.01/sec.

10. The process of claim 9, wherein the form conversion proportion during the form change is equal to or more than 20%.

11. A process for producing a metal material with improved mechanical properties, comprising the steps of:

a. producing a metal having a melting temperature (Tm) and a glass transition temperature (Tg);

b. placing the metal in a supercooled liquid state by setting the temperature (T) of the metal in a range of $Tg \leqq T \leqq Tm$;

c. causing the supercooled liquid metal to flow so that it changes forms from a first form to a second form, thereby causing the temperature of the supercooled liquid metal to increase;

d. allowing the temperature of the supercooled liquid metal of a changed form to become uniform, thereby inhibiting the production of non-uniform crystal nuclei; and e. thereafter subjecting the supercooled liquid of a changed form to a cooling treatment to solidify said supercooled liquid.

12. A process for producing a metal material with improved mechanical properties, comprising the steps of:

a. producing a metal having a melting temperature (Tm) and a glass transition temperature (Tg);

b. placing the metal in a supercooled liquid state by setting the temperature (T) of the metal in a range of $Tg \leqq T \leqq Tm$;

c. causing the supercooled liquid metal to flow so that it changes forms from a first form to a second form, thereby causing the temperature of the supercooled liquid metal to increase, the viscosity A of the supercooled liquid at the start of the form conversion is set at a value equal to or more than $5\times10^{-2}$ ($A \geqq 5\times10^{-2}$), the form conversion rate B is set at a value equal to or more than 0.01/sec ($B \geqq 0.01$/sec), and the form conversion proportion C is set at a value equal to or more than 20% ($C \geqq 20\%$);

d. allowing the temperature of the supercooled liquid metal of a changed form to become uniforms, thereby inhibiting the production of non-uniform crystal nuclei; and e. thereafter subjecting the supercooled liquid metal of a changed form to a cooling treatment to solidify the supercooled liquid.

13. A process for producing a metal material with improved mechanical properties, comprising the steps of:

a. producing a metal having a melting temperature (Tm) and a glass transition temperature (Tg);

b. placing the metal in a supercooled liquid state by setting the temperature (T) of the metal in a range of $Tg \leqq T \leqq Tm$;

c. causing the supercooled liquid metal having a first temperature less than the melting temperature for the metal to flow so that it changes forms from a first form to a second form, thereby causing the temperature of the supercooled liquid metal to increase to a second temperature;

d. allowing the temperature of the supercooled liquid metal of a changed form to become uniform, thereby inhibiting the production of non-uniform crystal nuclei; and e. thereafter, before the metal naturally cools to a temperature of greater than approximately 32 K below the first temperature, subjecting the supercooled liquid metal to a forced cooling treatment to thereby solidify the supercooled metal and maintain the metallographic structure of the supercooled liquid metal in the solidified metal.

14. The process of claim 13, wherein the viscosity of the supercooled liquid metal at the start of the form change is equal to or more than $5\times10^{-2}$ Pa.s.

15. The process of claim 13, wherein the form conversion rate during the form change is equal to or more than 0.01/sec.

16. The process of claim 13, wherein the form conversion proportion during the form change is equal to or more than 20%.

17. The process of claim 16, wherein the viscosity of the supercooled liquid metal at the start of the form change is equal to or more than $5\times10^{-2}$ Pa.s.

18. The process of claim 16, wherein a form conversion rate during the form change is equal to or more than 0.01/sec.

19. The process of claim 14, wherein the form conversion rate during the form change is equal to or more than 0.01/sec.

20. The process of claim 19, wherein the form conversion proportion during the form change is equal to or more than 20%.

* * * * *